US009052696B2

(12) United States Patent
Breuillot et al.

(10) Patent No.: US 9,052,696 B2
(45) Date of Patent: Jun. 9, 2015

(54) CONTROL DEVICE FOR A TIMEPIECE

(71) Applicant: Société anonyme de la Manufacture d'horlogerie Audemars Piguet & Cie, Le Brassus (CH)

(72) Inventors: Julien Breuillot, Bois d'Amont (CH); Marc Hodebourg, Le Brassus (CH)

(73) Assignee: Societe anonyme de la Manufacture d'horlogerie Audemars Piguet & Cie, Le Brassus (CH)

( * ) Notice: Subject to any disclaimer, the term of this patent is extended or adjusted under 35 U.S.C. 154(b) by 0 days.

(21) Appl. No.: 14/316,290

(22) Filed: Jun. 26, 2014

(65) Prior Publication Data

US 2015/0023142 A1 Jan. 22, 2015

(30) Foreign Application Priority Data

Jul. 17, 2013 (CH) ..... 1276/13

(51) Int. Cl.
*G04B 3/04* (2006.01)
*G04B 37/10* (2006.01)

(52) U.S. Cl.
CPC ..... *G04B 37/103* (2013.01); *G04B 3/046* (2013.01); *G04B 37/10* (2013.01)

(58) Field of Classification Search
CPC ..... G04B 37/10; G04B 37/103
USPC ..... 368/103, 139, 288–290
See application file for complete search history.

(56) References Cited

U.S. PATENT DOCUMENTS

| | | | | |
|---|---|---|---|---|
| 879,208 | A | 2/1908 | Sporleder | |
| 1,755,171 | A | 4/1930 | Bartenbach | |
| 2,482,317 | A * | 9/1949 | Borer | 368/288 |
| 2,645,077 | A | 7/1953 | Olson | |
| 3,039,262 | A | 6/1962 | Dicke | |
| 3,146,580 | A * | 9/1964 | Simon | 368/289 |
| 3,192,703 | A | 7/1965 | Dicke | |
| 3,362,154 | A * | 1/1968 | Perret | 368/290 |
| 3,453,819 | A * | 7/1969 | Simon | 368/290 |

FOREIGN PATENT DOCUMENTS

| | | |
|---|---|---|
| CH | 205961 | 10/1939 |
| CH | 503 310 | 10/1970 |
| CH | 520 352 | 9/1971 |
| CH | 646 568 A3 | 12/1984 |
| CH | 695 470 A5 | 5/2006 |

(Continued)

*Primary Examiner* — Sean Kayes
(74) *Attorney, Agent, or Firm* — Christensen Fonder P.A.

(57) ABSTRACT

A control device for a timepiece, the device including a primary crown adapted to be rotated and pulled, having at least two axial positions, and also including a secondary crown arranged coaxially with respect to the primary crown, the primary crown including a crown head and a control rod fixed rigidly to the crown head and adapted to be coupled to or decoupled from a winding rod of a movement of the timepiece in order to control functions of the timepiece, and the secondary crown including a crown body. The control device distinguishes in that the secondary crown is adapted be rotated and pulled, has at least two axial positions, and includes a kinematic link adapted to control at least one additional function of the timepiece, the primary crown and secondary crown being actuatable independently of one another. The invention also includes a timepiece having such a control device.

17 Claims, 4 Drawing Sheets

(56) References Cited

FOREIGN PATENT DOCUMENTS

| | | | |
|---|---|---|---|
| CH | 700 934 | B1 | 11/2010 |
| CH | 700 958 | A2 | 11/2010 |
| CH | 704 262 | A1 | 6/2012 |
| DE | 1 910 702 | | 9/1970 |
| EP | 2 017 683 | A2 | 1/2009 |
| JP | 2010-139400 | A | 6/2010 |
| JP | 2010-145098 | A | 7/2010 |
| WO | WO 2007/076966 | A1 | 7/2007 |

* cited by examiner

CONTROL DEVICE FOR A TIMEPIECE

RELATED APPLICATION

The present application claims priority to Swiss Patent Application No. CH 01276/13 filed Jul. 17, 2013, the disclosure of which is hereby incorporated by reference herein in its entirety.

FIELD OF THE INVENTION

The present invention relates to a control device for a timepiece, comprising a primary crown able to be rotated and pulled, having at least two axial positions, and also comprising a secondary crown arranged coaxially with respect to the primary crown, said primary crown comprising a crown head and a control rod fixed rigidly to the crown head and adapted to be coupled to or decoupled from a winding rod of a movement of said timepiece so as to control functions of the timepiece, and said secondary crown comprising a crown body.

BACKGROUND OF THE INVENTION

This invention falls within the framework of high-end watchmaking and more specifically relates to wristlet watches having a mechanical movement. In this field, it is usual to equip the timepieces with numerous functions which require corresponding control means housed on the watch case. So as to allow the basic functions, which normally include the manual winding of the power source of the movement of the timepiece, the hand-setting thereof, and, where appropriate, the correction of the date, the primary control means of such timepieces, the crown being placed commonly at the position of 3 o'clock on the rim of the case, often comprises two or even three corresponding axial positions. Depending on the type of timepiece, the crown may have a fourth, screwed position so as to secure it against any accidental actuation and to consolidate the water-tightness. In order to perform further functions integrated in such timepieces, such as a display of the diving time via a bezel, a chronograph, a setting of a second time zone, a glass or bezel actuation, a locking of push-buttons or other watch parts, the actuation of a striking-work mechanism or other complications, it is currently conventional to place other corresponding control means, such as a push-button or a second crown, at another position on the rim of the case, for example at 8 o'clock or 10 o'clock. This may have a detrimental effect on the appearance of the timepiece and may pose technical problems depending on the type of timepiece, the function to be controlled by the additional control means, in particular if the latter is kinematically linked with the components of the movement, the number of additional functions to be controlled, the available space, etc. The arrangement of one or more additional control means next to a primary crown and at different locations on the rim of the watch case therefore is not always a satisfactory solution for integrating further functions in a timepiece.

There are also some approaches for integrating an additional control means coaxially with respect to the primary crown and at the same location on the rim of the case as the primary crown. By way of example, the coaxial crown system disclosed in Swiss patent application CH 700 958 can be mentioned. This document concerns a watch comprising a watch movement mounted in a mobile manner in a case, such that it is not possible to fit the watch with a conventional crown having a winding rod passing through the case and the movement. The document thus proposes a system of coaxial crowns making it possible, on the one hand and by means of an additional crown that can only be actuated rotatably, to block the movement and to control the position of the winding rod, and, on the other hand and by means of a primary crown that likewise can only be actuated rotatably, to control the conventional winding and hand-setting functions. The two crowns thus each have only one axial position, given that this is a very specific case in which the movement is in rotation, such that only the winding rod can occupy a number of axial positions within the case. The kinematic connection between the primary crown and the winding rod is additionally ensured by a system comprising a ring and corresponding pinions. It should also be noted that the additional crown arranged coaxially with respect to the primary crown serves in this case only to control the blocking of the movement and the position of the winding rod, which, due to the rotation of the movement, cannot be selected directly by the axial displacement of the primary crown, such that this control system cannot be considered as allowing the control of an additional function of the timepiece, but is simply necessary for the mobile arrangement of the movement.

A further example of a system comprising a control device arranged coaxially with respect to the primary crown and at the same location on the rim of the case as the primary crown is disclosed in Swiss patent application CH 646 568. This document describes a watch comprising a first crown having two axial positions, making it possible to perform a hand-setting operation, as well as a device referred to as a second crown, which is blocked in rotation but is displaceable in translation so as to also have two axial positions and which makes it possible to select whether the hand-setting, by means of the first crown, is performed by steps of half an hour or continuously. The second crown arranged coaxially with respect to the primary crown cannot be actuated without first displacing the primary crown in its pulled position, and its actuation can be made difficult intentionally, amongst others so as to necessitate an instrument for actuating it. If the document refers to a second crown, this is thus rather a push-button enabling the choice between two functions of the primary crown, such that said device again cannot be considered as a crown enabling the control of an additional function of the timepiece.

In this context, it can be noted lastly that there are numerous documents, for example documents CH 704 262, CH 700 934, CH 520 352, CH 503 310, WO2007/076966 and EP 2 017 683, which disclose timepieces comprising a crown linked kinematically to a control rod that can be rotated and pulled as well as a blocking system allowing to block said control rod. The blocking system, which is arranged coaxially with respect to the crown in the embodiments described in the above-cited documents, can be arranged differently and allows to block the crown. It should be noted that these blocking systems, although their outer elements may have the form of a crown, do not perform any function associated with the movement or with another display or an additional function of the timepiece. Thus, none of these blocking systems can be used as a secondary crown controlling an additional function of a timepiece or for a corresponding cooperation with another part of said timepiece.

It should therefore be noted that the solutions of the prior art currently known in the field of horology only allow to control functions other than those controlled by the primary crown of a timepiece by one or more additional control means provided next to the primary crown and at different locations on the rim of the case. As explained above, this is not always a satisfactory solution for aesthetical and/or technical reasons.

SUMMARY OF THE INVENTION

An object of the present invention is therefore to overcome the disadvantages of the known devices and to realize a control means adapted to control at least one additional function of a timepiece that cannot be controlled by the primary crown thereof, without the need to provide control devices at a number of locations on the rim of the case. A further object of the present invention is to realize this control means by a robust construction that is also simple and reliable during use. A further object of the present invention is to improve the appearance of corresponding timepieces and to increase the degree of freedom at design level.

To this end, the present invention proposes a control device of the above-mentioned type, which is distinguished by the features specified in Claim 1. In particular, a device according to the present invention comprises a secondary crown, which is arranged coaxially with respect to the primary crown, can be rotated and pulled, has at least two axial positions, and comprises a kinematic link adapted to control at least one additional function of said timepiece, said primary and secondary crowns being actuatable independently of one another.

As a result of these measures, two crowns arranged coaxially at the same location are available to the user, enabling him to control suitably and independently a number of functions of his timepiece. He can use these crowns in a simple and quick manner. Moreover, the manufacturer of the timepiece has additional options for the technical integration of functions and also for the design for the timepiece.

Said kinematic link of the secondary crown preferably comprises coupling means and a mobile element, the coupling means being adapted to be coupled to or decoupled from the mobile element so as to enable the control of a function of the movement of said timepiece and/or of a further element of said timepiece. This arrangement is a particularly simple and reliable embodiment of the device.

Further features and the corresponding advantages will become clear from the dependent claims and also from the description specifying the invention in greater detail hereinafter.

BRIEF DESCRIPTION OF THE DRAWINGS

The accompanying drawings schematically show an embodiment of the invention by way of example.

The invention will now be described in detail with reference to the accompanying drawings, which illustrate an embodiment of the invention by way of example.

DETAILED DESCRIPTION

The present invention relates to a control device intended for integration into a timepiece, preferably into a wrist watch. To simplify the language used, reference will be made synonymously hereinafter to a "timepiece" and "watch", without the intention of additionally limiting the scope of the corresponding explanations, which in any case apply to any type of mechanical or electronic timepiece. Likewise, the terms "control device" and "coaxial crowns" will be used synonymously when referring to the control device in order to simplify the language used.

Figure 1A:
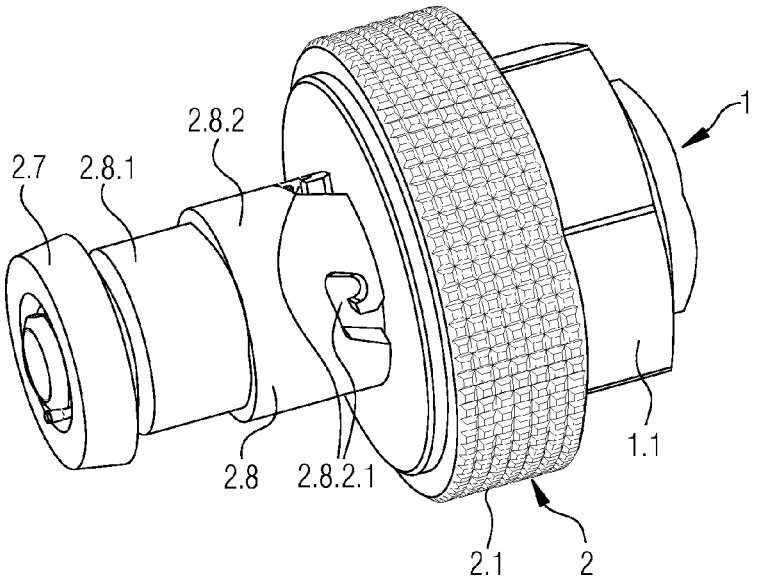
FIG. 1A shows a schematic perspective view of an embodiment of the control device according to the present invention in the assembled state, without the watch case in which said device is to be integrated.
Figure 1B:
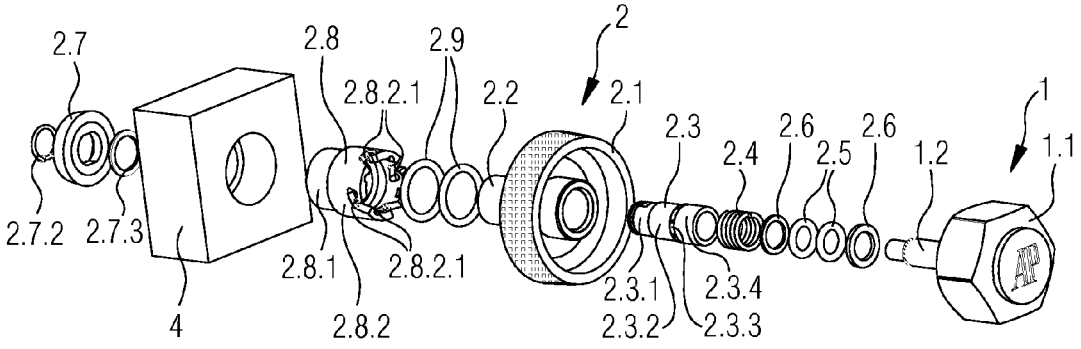
FIGS. 1B and 1C are exploded perspective views of the device schematically showing all the components thereof, as viewed laterally from the front and from the rear, and also partially showing the middle of the case in which the device is to be integrated.
Figure 1C:
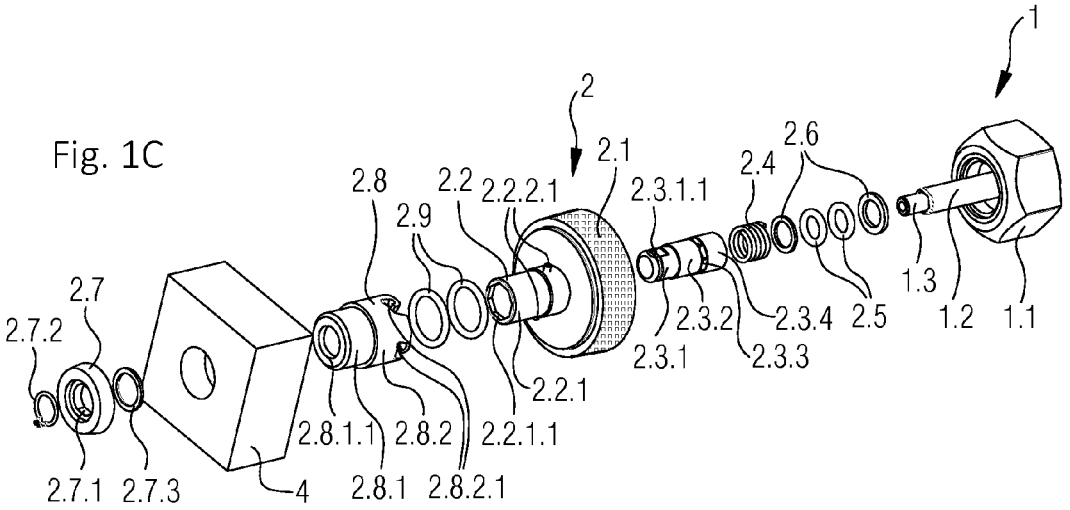

In order to comment first on the structure and the components of a control device according to the present invention, reference is made to FIGS 1A to 1C, which schematically illustrate, by way of example, an embodiment of such a device by means of perspective views, specifically in the assembled state of the device with regard to FIG. 1A and in an exploded view, as viewed laterally from the front and from the rear with regard to FIGS. 1B and 1C. FIG. 1A shows that the control device comprises a primary crown 1, which can be rotated and pulled, having at least two axial positions. In addition, the device comprises a secondary crown 2, which is arranged coaxially with respect to the primary crown 1 and which can also be rotated and pulled, having at least two axial positions. As will become clearer hereinafter, the primary crown 1 allows to control, for example, the basic functions of the timepiece, such as manual winding, hand-setting, and correction of the date, where necessary, whereas the secondary crown 2 allows to control an additional function, which can vary according to the requirements.

The primary crown 1 comprises a crown head 1.1 and a control rod 1.2 fixed rigidly to the crown head 1.1 and adapted to be coupled to or decoupled from a winding rod 5 for winding a movement of said timepiece, so that the primary crown 1 allows to control said functions of the timepiece. The secondary crown 2 comprises a crown body 2.1 and comprises a kinematic link, so that the secondary crown can control at least one additional function of said timepiece. The primary crown 1 and secondary crown 2 can be actuated independently from one another.

FIGS. 1B and 1C show the components of the control device in particularly clear manner. The control device is to be housed in the middle 4 of the case of the corresponding timepiece, the middle 4 being indicated only partially and symbolically in FIGS. 1B and 1C. The middle 4 to this end comprises a through-hole, preferably formed by two drilled holes of different diameter, the drilled hole of smaller diameter being arranged on the inner side of the case, and the drilled hole of larger diameter being arranged on the outer side of the case, the zone between the two drilled holes forming a shoulder arranged substantially at the centre of the wall of the middle 4. A fixed tube 2.8 having a length corresponding substantially to the thickness of the wall of the middle 4 and preferably having a homogeneous inner diameter is housed in said through-hole. This tube 2.8 is preferably separated into a first part 2.8.1, having a first outer diameter corresponding to the diameter of said small drilled hole in the middle 4, and into a second part 2.8.2, having a second outer diameter corresponding to the diameter of said large drilled hole in the middle 4, such that wall of the second part 2.8.2 of the tube 2.8 has a greater thickness. The tube 2.8 is terminated at its end oriented towards the inside of the case by an annular shoulder 2.8.1.1 forming a stop. Substantially hook-shaped slots 2.8.2.1 are formed on the end of the fixed tube 2.8 oriented towards the outside of the case. This arrangement can also be seen, in addition, in the cross section of the FIG. 2D. The tube 2.8 can be driven into the through-hole in the middle 4 or fixed there by any other suitable means. It is also possible, alternatively but less preferably for reasons of simplification of manufacture, to produce said structure in one piece with the middle 4.

A control tube 2.2 fixed rigidly to the crown body 2.1 of the secondary crown 2 is housed in the fixed tube 2.8 in such a way that the secondary crown 2 can be rotated and pulled and has at least two axial positions. So as to ensure the water-resistance of the device, at least one seal 2.9, preferably two seals 2.9 is/are fitted, between the fixed tube 2.8 and said control tube 2.2 of the secondary crown 2, in an annular groove arranged on the inner surface of the second part 2.8.2 of the fixed tube 2.8 having a greater thickness, as can be seen for example in FIG. 2D. Having a homogeneous inner diameter, the control tube 2.2 preferably comprises two parts 2.2.1 and 2.2.2 of different respective lengths and having a different wall thickness, of which the outer diameter corresponds substantially to the inner diameter of the fixed tube 2.8, as can be seen for example in FIGS. 1C and 2D. The second part 2.2.2, having a greater wall thickness and able to compress partly one of said seals 2.9 in the secured position of the secondary crown 2, carries at least one pin 2.2.2.1 fitted on its outer surface and adapted to engage with one of said slots 2.8.2.1 arranged on the end of the fixed tube 2.8 oriented towards the outside of the case. The slots 2.8.2.1 and the pins 2.2.2.1 thus form a blocking portion or blocking means 2.8.2.1, 2.2.2.1 for blocking the secondary crown 2, allowing blockage of the secondary crown on the timepiece. The second part 2.2.2 of the control tube 2.2 is fixed rigidly to the crown body 2.1 and preferably extends beyond the base wall of said crown body 2.1, which is pot-shaped, so as to create an empty annular space within the pot-shaped crown body 2.1, said empty space being oriented towards the outside of the crown body 2.1 of the secondary crown 2. The extension of the second part 2.2.2 of the control tube 2.2 comprises on its outer surface, that is to say in said empty annular space in the pot-shaped crown body 2.1, a second threading. The purpose of this threading provided on the side oriented towards the outside of the crown body 2.1 of the secondary crown 2 will become clearer hereinafter. The first part 2.2.1 of the control tube 2.2 having a smaller wall thickness is terminated at its end oriented towards the inside of the case by an annular shoulder forming a first coupling part 2.2.1.1.

A mobile tube 2.3 is housed within said control tube 2.2 of the secondary crown 2 in such a way that the secondary crown 2 can be rotated and also pulled and has at least two axial positions. This mobile tube 2.3 is also arranged simultaneously in contact with the fixed tube 2.8, such that the mobile tube 2.3 can be rotated, but cannot be moved in translation. To this end, the mobile tube 2.3 has a specific design and in particular comprises four sections 2.3.1, 2.3.2, 2.3.3, 2.3.4 of different outer diameter, while being separated into just two sections of different inner diameter of which the respective lengths are substantially similar, as also illustrated in FIGS. 1C and 2D.

The first section 2.3.1 of the mobile tube 2.3 having the smallest outer diameter of said four sections carries, on its end oriented towards the inside of the case, a pinion 2.7 that can rotate a horological component so as to control a function of the movement and/or of another element of the timepiece into which the control device is to be integrated. The pinion 2.7 can be driven over the first section 2.3.1 of the mobile tube 2.3, fixed with the aid of a fixing washer 2.7.2, or fitted by any other suitable means, once the mobile tube 2.3 has been introduced into the control tube 2.2 and once the control tube has been introduced into the fixed tube 2.8 fitted into the through-hole in the middle 4. The pinion 2.7 may comprise flat portions 2.7.1, which cooperate with corresponding flat portions 2.3.1.1 on the first section 2.3.1 of the mobile tube 2.3, so as to prevent any relative rotation between the pinion 2.7 and the mobile tube 2.3 and so as to facilitate the assembly thereof. A washer 2.7.2 can be fitted between the pinion 2.7 and the fixed tube 2.8. The outer diameter of the first section 2.3.1 of the mobile tube 2.3 additionally corresponds to the inner diameter of the annular shoulder 2.8.1.1 on the end of the fixed tube 2.8 oriented towards the inside of case, such that the mobile tube 2.3 can turn freely in this annular shoulder 2.8.1.1 of the fixed tube 2.

The second section 2.3.2 of the mobile tube 2.3 has an outer diameter that is slightly greater than the first section 2.3.1, such that the zone delimiting the first section 2.3.1 and the second section 2.3.2 forms a complementary stop cooperating with the stop formed by the annular shoulder 2.8.1.1 on the end of the fixed tube 2.8 oriented towards the inside of the case. As mentioned above, a free rotation of the mobile tube 2.3 housed in the annular shoulder 2.8.1.1 of the fixed tube 2.8 is thus possible, whereas an axial translation of the mobile tube 2.3 is not possible in the assembled state of the control device, since the annular shoulder 2.8.1.1 on the end of the fixed tube 2.8 is jammed, with little play, between said pinion 2.7, or the washer 2.7.2, and said complementary stop formed by the zone delimiting the first section 2.3.1 and second section 2.3.2 of the mobile tube 2.3.

The third section 2.3.3 of the mobile tube 2.3 has an outer diameter substantially equal to the outer diameter of the second section 2.3.2, but comprises on its outer rim a second coupling part 2.3.3.1, which is adapted to cooperate with the annular shoulder on the control tube 2.2 of the secondary crown 2 forming the above-mentioned first coupling part 2.2.1.1. The length of the third section 2.3.3 additionally corresponds substantially to the thickness of the wall of said annular shoulder on the control tube 2.2. Said coupling parts 2.2.1.1, 2.3.3.1 provided on the control tube 2.2 and the mobile tube 2.3 can engage with one another by means of a movement in axial translation of the control tube 2.2 and normally have a polygonal cross section corresponding with one another so as to allow to create a kinematic connection therebetween in order to transmit a rotational movement. The coupling parts 2.2.1.1, 2.3.3.1 are preferably hexagonal in cross section. It would also be possible, alternatively, to provide axial grooves, able to engage with one another, on the two coupling parts 2.2.1.1, 2.3.3.1.

The fourth section 2.3.4 of the mobile tube 2.3 has an outer diameter that is slightly greater than the second section 2.3.2 or the third section 2.3.3 of the mobile tube 2.3, such that the zone delimiting the third section 2.3.3 and fourth section 2.3.4 of the mobile tube 2.3 forms a stop which is able to cooperate with the annular shoulder on the control tube 2.2 of the secondary crown 2 forming the first coupling part 2.2.1.1, which can be seen in particular in FIG. 2D. This stop thus limits the axial displacement towards the outside of the control tube 2.2, which is displaceable on the mobile tube 2.3 in axial translation and in rotation, and even secures the secondary crown 2 on the timepiece. The control tube 2.2, or the secondary crown 2, thus has two axial positions, that is to say a first, secured position in which the first coupling part 2.2.1.1 of the control tube 2.2 is close to the annular shoulder 2.8.1.1 on the end of the fixed tube 2.8 and the coupling parts 2.2.1.1, 2.3.3.1 provided on the control tube 2.2 and on the mobile tube 2.3 are decoupled, as illustrated for example in FIG. 2A, and a second, actuation position in which the first coupling part 2.2.1.1 of the control tube 2.2 abuts the stop formed by the zone delimiting the third section 2.3.3 and fourth section 2.3.4 of the mobile tube 2.3 and the coupling parts 2.2.1.1, 2.3.3.1 provided on the control tube 2.2 and on the mobile tube 2.3 are coupled, as illustrated in FIG. 2D.

It can also be seen from FIGS. 1B and 1C that the control device also comprises a pretensioning spring 2.4 housed between the mobile tube 2.3 and the control tube 2.2 of the secondary crown 2. This pretensioning spring 2.4 is preferably formed by a coil spring of which the outer diameter corresponds substantially to the inner diameter of the control tube 2.2 and exerts a pretension which tries to move away the control tube 2.2 from the mobile tube 2.3. The spring is mounted in said control tube 2.2, on the side of the mobile tube 2.3 oriented towards the outside of the case, with the aid of at least one fixing washer 2.6. Two fixing washers 2.6 are preferably used, as illustrated in the figures, the first washer serving as a bearing surface for the pretensioning spring, whereas the second washer is fixed rigidly at the end of the control tube 2.2 oriented towards the outside of the case so as to secure the positioning of the other components, apart from the mobile tube 2.3, located within said control tube 2.2. In addition, at least one seal 2.5 can be fitted between the two fixing washers 2.6 so as to ensure the water-resistance of the control device between the control tube 2.2 and the mobile tube 2.3. The pretensioning spring 2.4 thus secures the secondary crown 2, in the secured position thereof, against any inadvertent actuation by pushing the pins 2.2.2.1 on the control tube 2.2 located in this position in the hook-shaped slits 2.8.2.1 on the fixed tube 2.8 at the base of the corresponding hook, thus blocking the secondary crown 2 on the timepiece. In the actuation position, the pretensioning spring 2.4 pushes the secondary crown 2, likewise by means of its pretensioning force, in the state in which the coupling parts 2.2.1.1, 2.3.3.1 provided on the control tube 2.2 and mobile tube 2.3 are coupled.

In view of the arrangement described above, it is understood that, in general terms, said kinematic link of the secondary crown 2 comprises a coupling portion or coupling means 2.2 and a mobile element 2.3, the coupling means 2.2 being adapted to be coupled to or decoupled from the mobile element 2.3 so as to allow to control a function of the movement and/or of another element of said timepiece. More specifically, the coupling portion, also referenced as the coupling means, is formed by the control tube 2.2 fixed rigidly on the crown body 2.1 of the secondary crown 2, and said mobile element is formed by the mobile tube 2.3, the control tube 2.2 and the mobile tube 2.3 each comprising a coupling part 2.2.1.1, 2.3.3.1 adapted to engage with one another by means of a movement of an axial translation of the control tube 2.2 so as to allow the transfer of a movement of rotation of the control tube 2.2 to the mobile tube 2.3.

In order to also describe in greater detail the primary crown 1 of the control device according to the present invention, it can be noted first that said primary crown can be formed by a crown included, itself as such and in principle, in the known prior art, such that the following description will be limited to the key features. As can be seen in FIGS. 1B and 1C, the primary crown 1, which can be rotated and pulled, having at least two axial positions, comprises a crown 10 head 1.1 and a control rod 1.2 fixed rigidly to the crown head 1.1. The control rod 1.2, in the assembled state of the control device, is housed inside the mobile tube 2.3, while being movable freely in rotation and in axial translation.

An empty annular zone is preferably formed between the control rod 1.2 and the crown head 1.1, this zone being able to receive said extension of the second part 2.2.2 of the control tube 2.2. In fact, the crown head 1.1 preferably has the shape of a pot of which the inner surface comprises a first threading able to cooperate with said second threading, which comprises, on its outer surface, the extension of the second part 2.2.2 of the control tube 2.2. The above-mentioned empty annular space located within the pot-shaped crown body 2.1 of the secondary crown 2 can thus receive the corresponding pot-shaped crown head 1.1 of the primary crown 1. The latter can then be screwed on the secondary crown 2 with the aid of said first and second threadings, which constitute blocking means allowing to block the primary crown 1 on the corresponding timepiece. This blocked position at the same time limits the axial displacement of the primary crown 1 in the direction towards the inside of the case.

The primary crown 1 also comprises a piston 1.3 and a return spring 1.4, both components being mounted in the control rod 1.2 of said primary crown. The piston 1.3 is mounted slidingly and displaceably in rotation in the control rod 1.2 and is adapted to be mounted rigidly on the winding rod 5 for winding the movement of said timepiece in which the control device is to be integrated. The return spring 1.4 in turn exerts a pretensioning force which tries to move away the piston 1.3 from the crown head 1.1, thus serving for providing a damping effect during the actuation of the primary crown 1 and for returning the piston 1.3, that is to say the winding rod 5, into its rest position when the primary crown 1 returns into its blocked position. The maximum distance between the piston 1.3 and the crown head 1.1, that is to say the limit of the axial displacement of the primary crown 1 in the direction towards the outside of the case, is defined by a shoulder on the end of the control rod 1.2 oriented towards the inside of the case, this shoulder likewise having a first polygonal zone on its inner rim able to cooperate with a second polygonal zone arranged along a part of the piston 1.3. Therefore, the primary crown 1, by means of a movement of an axial translation, is adapted to be coupled to or decoupled from said piston 1.3, respectively the winding rod 5 of the movement of said timepiece, said rod being fixed to the piston 1.3, such that the primary crown 1 allows to control said functions of the timepiece. As is conventional in the prior art, the primary crown 1 is thus able to be rotated and pulled and has two or even three axial positions, according to the requirements, in which it can be actuated as well as a blocked position in which it cannot be actuated.

In view of the foregoing, it is clear that a control device according to the present invention is fitted firstly by inserting the fixed tube 2.8 into the through-hole in the middle 4. The mobile tube 2.3 and the corresponding components 2.4, 2.5, 2.6 are then inserted into the control tube 2.2, then said control tube and the seals 2.9 are inserted into the fixed tube 2.8. These elements are then fixed in their positions by fitting the pinion 2.7 on the mobile tube 2.3. Lastly, the control rod 1.1 of the primary crown 1, including the piston 1.3 and the return spring 1.4, is inserted into the mobile tube 2.3 of the secondary crown 2, and the winding rod 5 of the movement of the timepiece is fixed to the piston 1.3.

Figure 2A:
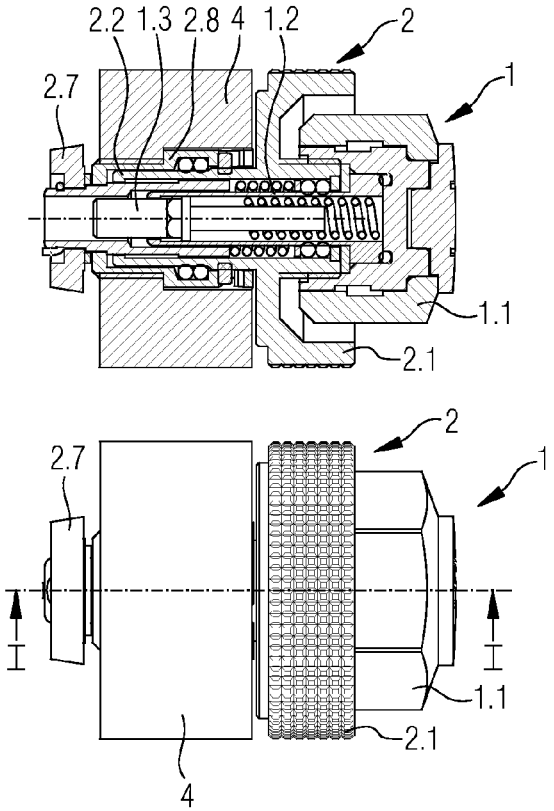
FIG. 2A shows a plan view of the control device and a corresponding cross section along a line I-I indicated in the aforementioned plan view, the primary crown of the device being arranged in its screwed position, and the secondary crown being arranged in its secured position.
Figure 2B:
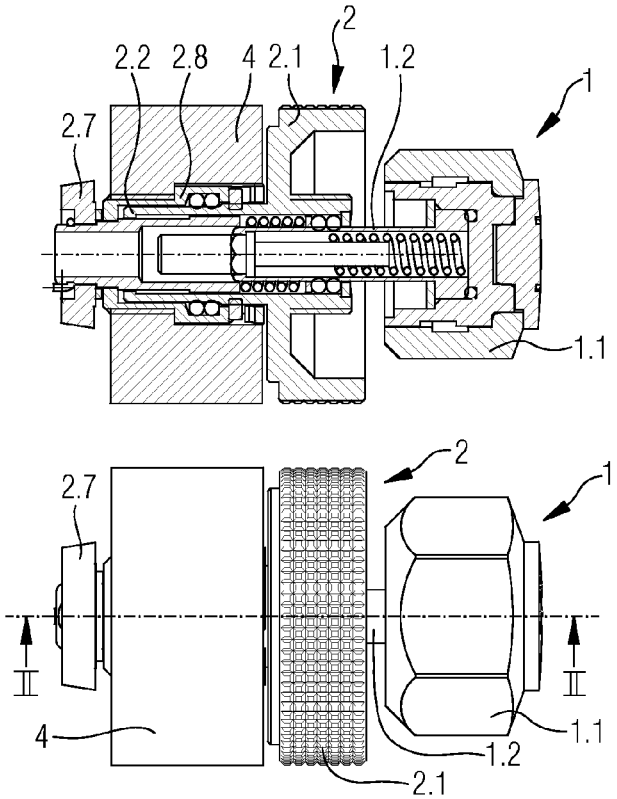
FIG. 2B shows a plan view of the control device and also a corresponding cross section along a line II-II indicated in the aforementioned plan view, the primary crown of the device being arranged in its first pulled position, allowing manual winding, and the secondary crown still being arranged in its secured position.
Figure 2C:
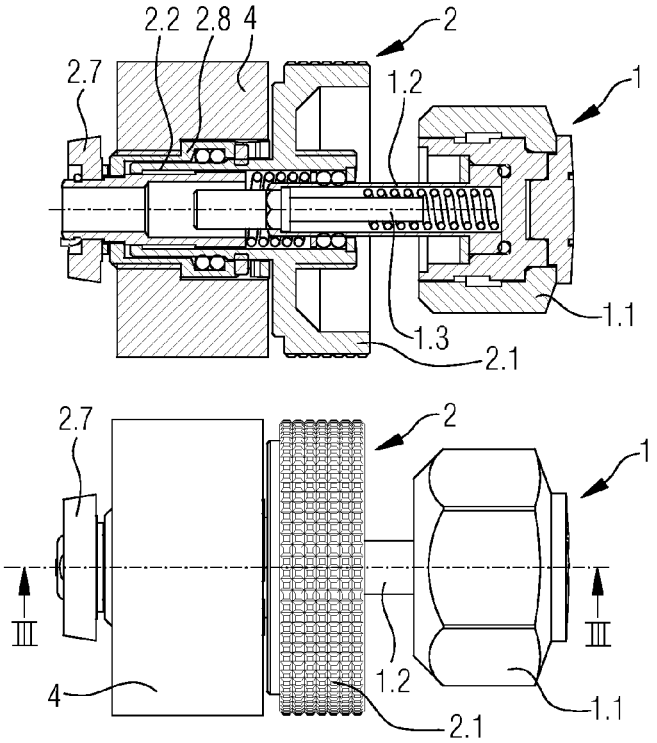
FIG. 2C shows a plan view of the control device and also a corresponding cross section along a line III-III indicated in the aforementioned plan view, the primary crown of the device being arranged in its second or third pulled position, allowing hand-setting, and the secondary crown still being arranged in its secured position.
Figure 2D:
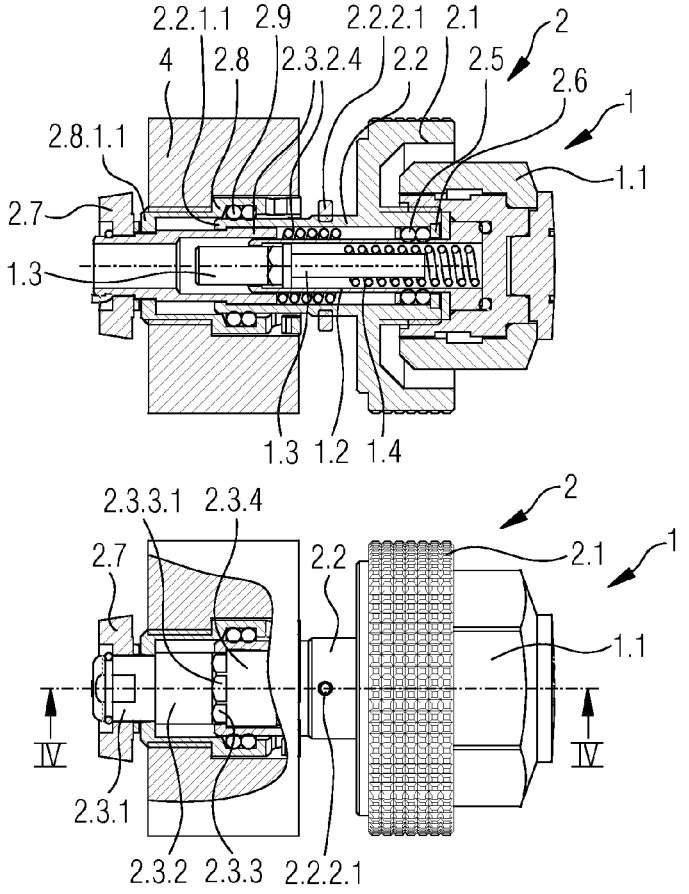
FIG. 2D shows a plan view of the control device and also a corresponding cross section along a line IV-IV indicated in the aforementioned plan view, the primary crown of the device being arranged in its screwed position, and the secondary crown being arranged in its actuation position, allowing to control an additional function of the timepiece.

The above explanations concerning the structure and the components of a control device according to the present invention also allow to understand easily the functioning of said device, in particular with the aid of FIGS. 2A to 2D. In fact, FIG. 2A shows a plan view of the control device and a corresponding cross section along a line I-I indicated in the aforementioned plan view, the primary crown 1 of the device being located in its screwed position, and the secondary crown 2 being located in its secured position. The primary crown 1 and the secondary crown 2 therefore are not in a coupled position and cannot be actuated.

FIG. 2B shows a plan view of the control device and a corresponding cross section along a line II-II indicated in the aforementioned plan view when the primary crown 1 of the device is located in its first pulled position, once the user has unscrewed the primary crown 1 and pulled it in a direction away from the watch, such that the first polygonal zone on the inner rim of the shoulder located on the end of the control rod 1.2 oriented towards the inside of the case is coupled to the second polygonal zone arranged on the piston 1.3. The winding rod 5 can thus be rotated by turning the primary crown 1. In this position, the primary crown 1 typically allows the manual winding of the corresponding timepiece. The secondary crown 2 is still located in its secured position and therefore is not in a coupled position and cannot be actuated.

FIG. 2C shows a plan view of the control device and a corresponding cross section along a line indicated in the aforementioned plan view when the primary crown 1 of the device is located in its second or its third pulled position, once the user has unscrewed the primary crown 1 and pulled it even further away from the watch. The control rod 1.2 and the piston 1.3 are still coupled as described within the context of FIG. 2B, but the primary crown 1 and the winding rod 5 are located in a position axially displaced with respect to the above-described situation. According to the requirements, the primary crown 1 typically allows in this position to perform a hand-setting operation or a correction of the date of the corresponding timepiece, however it is conceivable to control a different function. The secondary crown 2 is still located in its secured position, such that it is not in a coupled position and cannot be actuated.

FIG. 2D lastly shows a plan view of the control device and a corresponding cross section along a line IV-IV indicated in the aforementioned plan view when the primary crown 1 of the device is located in its screwed position, the control rod 1.2 thus being decoupled from the piston 1.3, and the secondary crown 2 being located in its actuation position allowing to control an additional function of the timepiece. In order to bring the secondary crown 2 into this position, it is sufficient for the user to press on the secondary crown 2, then to turn it slightly in an anti-clockwise direction, such that the pins 2.2.2.1 on the control tube 2.2 can disengage from the hook-shaped slits 2.8.2.1 on the fixed tube 2.8. When the user removes the pressure on the secondary crown 2, the pretensioning spring 2.4 then automatically brings the secondary crown 2 into the actuation position thereof, in which the first coupling part 2.2.1.1 provided on the control tube 2.2 is coupled with the second coupling part 2.3.3.1 provided on the mobile tube 2.3, thus allowing to rotate the mobile tube 2.3 and the pinion 2.7 thereof, respectively the horological component linked kinematically to said pinion 2.7, by turning the secondary crown 2. It is thus possible, on the one hand, to actuate the primary crown 1 and secondary crown 2 independently of one another and, on the other hand, to control any kind of additional function of the timepiece by means of the secondary crown 2. To this end, thanks to the coaxial arrangement of the primary crown 1 and secondary crown 2 according to the present invention, it is not necessary to provide a control means at a position on the rim of the case other than at the location of the primary crown 1. It is preferable, but not absolutely necessary, for the primary crown 1 to be actuated when the secondary crown 2 is in a secured position, and vice versa, as indicated above and illustrated in FIGS. 2A to 2D.

Figure 3:
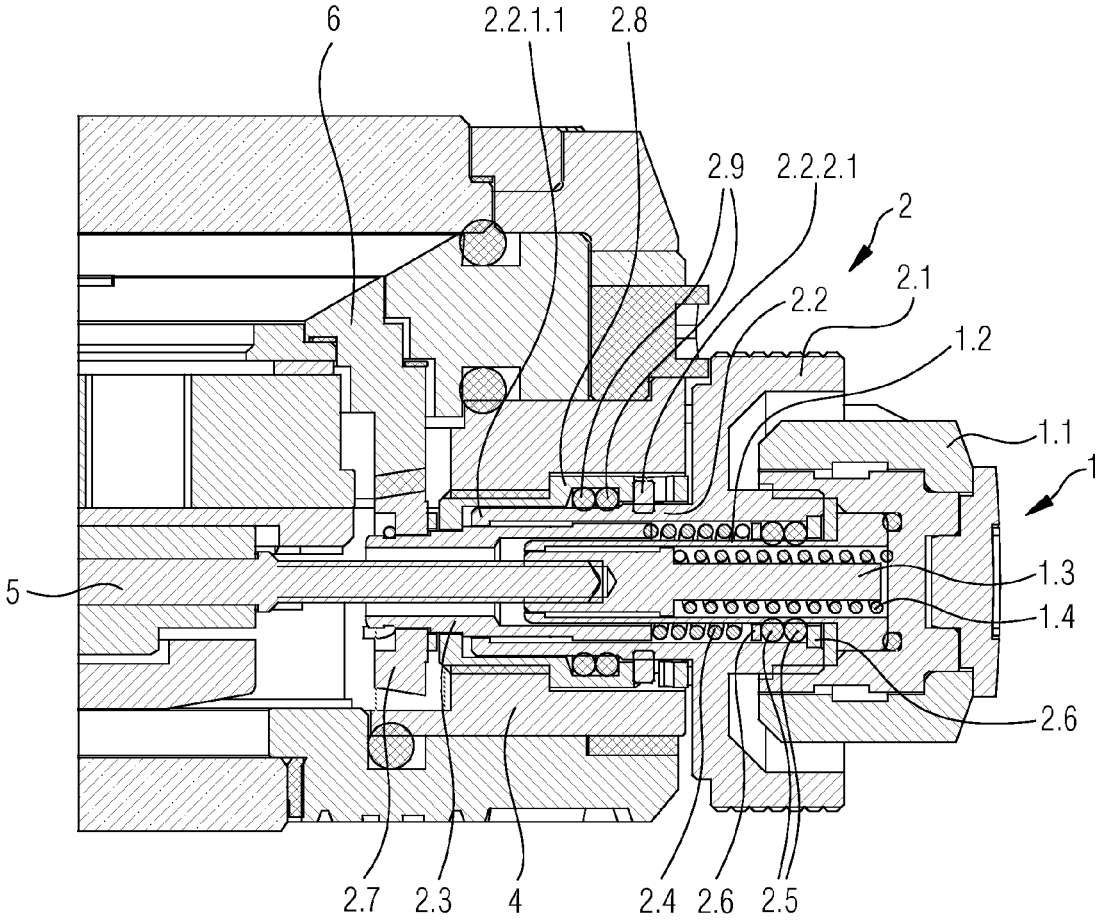
FIG. 3 is a section through a timepiece comprising a control device according to the present invention, which is used, in an exemplary application, to control a bezel integrated beneath the glass of the timepiece.

The control device according to the present invention can be integrated in any kind of timepiece, preferably in mechanical wrist watches, that is to say wrist watches having a mechanical movement. It is also possible however to use the control devices in electronic watches. One exemplary application of the device is illustrated schematically in FIG. 3A, which shows a cross section through a watch which comprises a bezel 6, of which the position can be adjusted by means of the secondary crown 2 of said control device. In fact, the toothing of the pinion 2.7 mounted on the mobile tube 2.3 of the device meshes with a toothing provided on the inner surface of the bezel 6, such that it is clear that any rotation of the secondary crown 2 by the user, when said secondary crown is in the actuation position thereof, causes a corresponding rotation of the bezel 6.

In general, the control device can be used to control any additional function of the timepiece into which the device is to be integrated, whether associated with the movement or with another element of said timepiece. Without going into detail, further exemplary applications could thus include the actuation of a glass or the control of a bezel mounted rotatably about the glass of a watch in order to display any kind of information, such as a remaining diving time or a time zone, or the locking of push-pieces or of another part of the timepiece, to enumerate applications relating to an element not associated with the movement of the timepiece. Further applications relating to elements of the movement of the timepiece include, for example, the control of a chronograph hand, a striking-work, an alarm, or the setting of the hands of the second time zone.

Lastly, it remains to be noted that, in the embodiment of the control device illustrated in the figures, the primary crown 1 is housed within the secondary crown 2. The principle and technical instruction of the invention disclosed herein to a person skilled in the art can also be transferred, however, to the case in which a secondary crown 2 is mounted within a primary crown 1 arranged in a corresponding manner, in particular by forming the winding rod by a tube. It is therefore clear for a person skilled in the art aware of the technical instruction of the present invention that, on the one hand, further alternative embodiments of such a control device are conceivable, without it being possible or necessary to describe all of said alternative embodiments explicitly here, and, on the other hand, that these embodiments lie within the sphere or scope of protection of the present invention.

In view of the above explanations relating to the structure and to the functioning of the control device according to the present invention, it is clear that such a device has numerous advantages and allows to achieve the objects stated in the introduction. In particular, a device according to the present invention offers, on the one hand, a neat solution for controlling any sort of additional function compared with the basic functions controlled by the primary crown of a watch by means of a secondary crown. On the other hand, it offers a solution for integrating the primary crown and secondary crown in such a way that allows them to be actuated independently of one another. In addition, thanks to the coaxial arrangement of the primary crown and secondary crown according to present invention, it is not necessary to provide a control means at a position on the rim of the case other than the location at which the primary crown 1 is situated. The construction is robust and reliable during use, in particular due to the fact that the primary crown and secondary crown both have a blocked or secured position. The device can be used intuitively by the user of the watch. In addition, the concept is aesthetically pleasing and allows the manufacturer a greater degree of freedom than before in terms of the design of the corresponding timepiece. It should also be mentioned that the device according to the present invention can be provided in a number of variants and is thus based on a principle of versatile construction. Due to the cooperation between the primary crown and a conventional winding rod and also the presence of a pinion on the secondary crown, the device can be easily integrated in any type of timepiece, without the need to make significant modifications to the timepiece. It is clear to see that, in practice, the primary advantages are particularly favourable for the field of high-end mechanical wristwatches.

The invention claimed is:

1. A control device for a timepiece, the device comprising a primary crown adapted to be rotated and pulled, having at least two axial positions, and also comprising a secondary crown arranged coaxially with respect to the primary crown, said primary crown comprising a crown head and a control rod fixed rigidly to the crown head and adapted to be coupled to or decoupled from a winding rod of a movement of said timepiece in order to control functions of the timepiece, and said secondary crown comprising a crown body, wherein said secondary crown is adapted to be rotated and pulled, having at least two axial positions, and comprises a kinematic link adapted to control at least one additional function of said timepiece, said primary crown and secondary crown being actuatable independently of one another.

2. The device according to claim 1, wherein said kinematic link of the secondary crown comprises a coupling portion and a mobile element, the coupling portion being adapted to be coupled to or decoupled from the mobile element so as to allow to control a function of the movement of said timepiece and/or of another element of said timepiece.

3. The device according to claim 2, wherein said coupling portion is formed by a control tube fixed rigidly to the crown body of the secondary crown, and said mobile element is formed by a mobile tube housed within the control tube so as to be able to turn freely, the control tube and the mobile tube each comprising a coupling part adapted to engage with one another by a movement of translation of the control tube so as to allow the transfer of a movement in rotation of the control tube to the mobile tube.

4. The device according to claim 3, wherein said coupling parts adapted to engage with one another provided on the control tube and on the mobile tube are polygonal in section, preferably hexagonal in section.

5. The device according to claim 4, wherein said coupling parts are hexagonal in section.

6. The device according to claim 3, wherein said control tube of the secondary crown is housed, such that the secondary crown is adapted to be rotated and pulled and has at least two axial positions, in a fixed tube mounted in a middle of a case of the timepiece into which the device is to be integrated, said mobile tube being housed within the control tube of the secondary crown and within said fixed tube so as to be actuatable in rotation but not displaceable in translation.

7. The device according to claim 6, wherein said secondary crown comprises a blocking portion allowing blockage of the secondary crown on said timepiece.

8. The device according to claim 6, wherein said blocking portion is formed by substantially hook-shaped slits formed on an outer end of the fixed tube and by at least one pin mounted on an outer surface of the control tube of the secondary crown and adapted to engage with one of said slits.

9. The device according to claim 3, wherein said mobile tube comprises, on an end oriented towards the inside of the timepiece into which the device is to be integrated, a pinion adapted to drive in rotation a horological component so as to control a function of the movement of said timepiece and/or of another element of said timepiece.

10. The device according to claim 3, wherein the secondary crown comprises a pretensioning spring housed between the mobile tube and control tube and exerting a pretensioning force trying to move away the control tube from the mobile tube.

11. The device according to claim 1, wherein said primary crown comprises a blocking portion allowing blockage of the primary crown on said timepiece.

12. The device according to claim 11, wherein said blocking portion is formed by a first threading provided on an inner surface of the crown head of the primary crown and by a second threading provided on a side oriented towards an outside of the crown body of the secondary crown.

13. The device according to claim 1, wherein said primary crown comprises a piston and a return spring, said piston being mounted slidingly and so as to be displaceable in rotation in the control rod fixed rigidly to the crown head and being adapted to be mounted rigidly on the winding rod of the movement of said timepiece, said return spring exerting a pretensioning force trying to move away the piston from the crown head.

14. The device according to claim 1, wherein the primary crown is adapted to be rotated and pulled and has three axial positions in which the primary crown can be actuated and one blocked position in which the primary crown cannot be actuated.

15. A timepiece, preferably a mechanical wrist watch, wherein the timepiece comprises a control device according to claim 1.

16. The timepiece according to claim 15, wherein the timepiece is a mechanical wrist watch.

17. The timepiece according to claim 15, wherein it comprises a bezel, of which a position can be adjusted by movement of the secondary crown of said control device.

* * * * *